United States Patent [19]

Fox et al.

[11] Patent Number: 4,676,401

[45] Date of Patent: Jun. 30, 1987

[54] UNITARY DISPENSER FOR A WHIPPED BEVERAGE

[75] Inventors: David Fox; Richard S. Stein, both of Encino, Calif.

[73] Assignee: Orange Bang, Inc., Sun Valley, Calif.

[21] Appl. No.: 679,231

[22] Filed: Dec. 7, 1984

[51] Int. Cl.[4] ..... B67B 7/00; B67D 5/56

[52] U.S. Cl. ..... 222/1; 222/129.1; 222/148; 222/190; 261/90

[58] Field of Search ..... 366/168, 172, 173, 604; 141/69, 361; 261/90, 101, 102, 84, DIG. 16, DIG. 22; 222/129, 129.1–129.4, 132, 145, 333, 190; 277/25, 81 R, 95

[56] References Cited

U.S. PATENT DOCUMENTS

| | | | |
|---|---|---|---|
| 1,435,883 | 11/1922 | Spohn | 222/54 X |
| 2,418,707 | 4/1947 | Groot | 277/25 |
| 2,919,726 | 1/1960 | Zimmermann et al. | 222/190 X |
| 3,168,292 | 2/1965 | Joschko | 259/9 |
| 3,411,671 | 11/1968 | Harvey et al. | 222/333 X |
| 3,529,749 | 9/1970 | Lehmann et al. | 222/129.1 X |
| 3,625,402 | 12/1971 | Kulis | 222/129.3 |
| 3,800,826 | 4/1974 | McCann | 137/560 |
| 4,086,306 | 4/1978 | Yoshinaga | 261/93 |
| 4,185,927 | 1/1980 | Uttech | 366/131 |
| 4,262,371 | 4/1981 | Berry et al. | 4/191 |
| 4,478,357 | 10/1984 | Jenkins | 222/135 |

*Primary Examiner*—Joseph J. Rolla
*Assistant Examiner*—Michael S. Huppert
*Attorney, Agent, or Firm*—Spensley Horn Jubas & Lubitz

[57] ABSTRACT

A dispension for whipped beverages made from a concentrate and diluent. The dispenser includes a head structure forming a whipping cavity. A funnel is removably inserted into the cavity bottom. Two conduits communicating with the cavity are formed in the head to introduce concentrate and diluent into the cavity. An air passageway is formed in the head and intersects the diluent conduit downstream from the solenoid valve. A tube is inserted into the air passageway and partially extends into the diluent conduit to introduce air into the diluent conduit via a venturi effect. A whipping motor has an output shaft disposed through a bore in the head and partially residing in the cavity below the conduits. A paddle is connected to the motor shaft within the cavity. A resilient slinger washer is disposed in a circumferential groove about the shaft. The whipped beverage is produced by simultaneously introducing separately stored concentrate and diluent into the cavity where they mixed, and agitated along with venturi-induced air to form the whipped beverage.

25 Claims, 7 Drawing Figures

FIG. 1
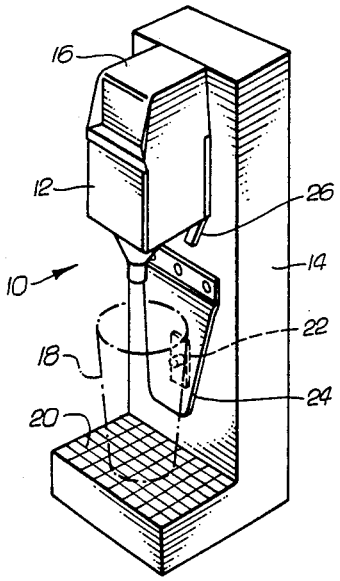
FIG. 2
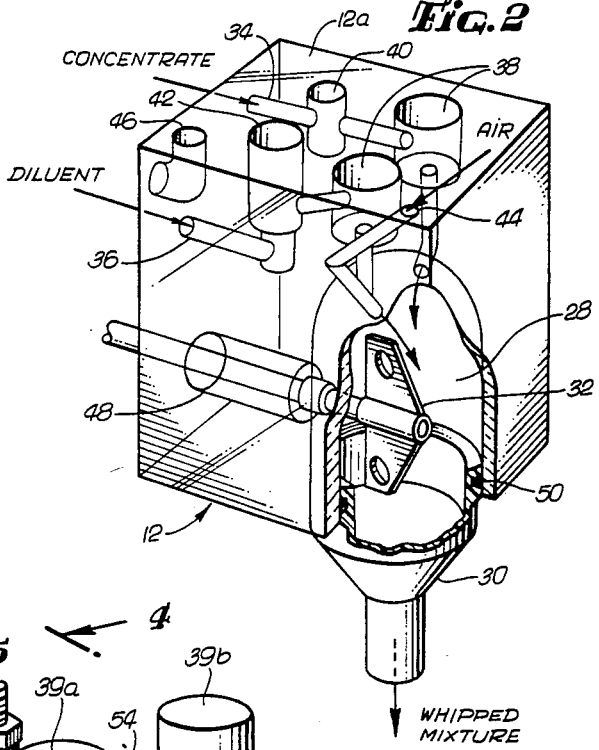
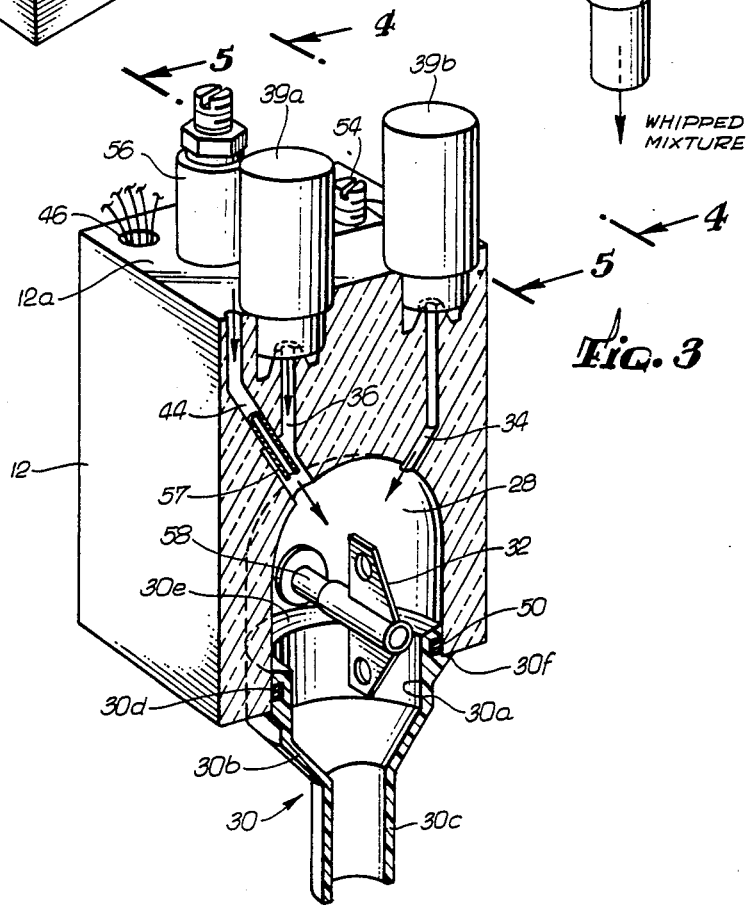
FIG. 3

UNITARY DISPENSER FOR A WHIPPED BEVERAGE

BACKGROUND OF THE INVENTION

1. Field of the Invention

The present invention concerns beverage dispensers and more particularly a dispenser for agitated or whipped beverages.

2. Description of the Prior Art

There are presently a number of popular beverages sold in restaurants and fast-food businesses which are served in a whipped or foamed condition. That is, the beverage is agitated or whipped in the dispensing process to give the served beverage a foamy texture. Typically these beverages are made from a combination of a concentrate and a diluent, usually water. The concentrate by itself generally does not require refrigeration and has a shelf life of several months to over a year. However, when mixed with a diluent such as water or exposed to air, the combined beverage usually requires refrigeration to retard bacterial growth.

Generally, pre-mixed dispensers are used for serving whipped beverages. In a pre-mixed dispenser, a quantity of concentrate and diluent are pre-mixed and stored in a large volume refrigerated reservoir. The refrigerated reservoir is connected to a flow valve which is in turn connected to an agitation or whipping apparatus having a dispensing spout. To dispense the beverage, the flow valve is opened and the whipping apparatus simultaneously activated. The beverage flows from the refrigerated reservoir, through the flow valve, into the whipping apparatus to be dispensed in a whipped condition.

Pre-mixed dispensers suffers from a number of disadvantages. Even with refrigeration, some bacterial growth is present. Consequently, after a period of time, typically a few days, any remaining pre-mixed beverage should be discarded to maintain healthful quality and pleasing beverage taste. Since the whipping assembly portion of the dispenser is usually not refrigerated, it is typically necessary to disassemble and clean the whipping assembly on a daily basis to remove accumulated beverage residue remaining in the whipping apparatus. Because some beverage remains in the whipping apparatus after each serving, it is also possible for bacterial growth to affect the taste and quality of a later beverage serving if a sufficient period of time elapses between servings.

Thus, there presently exists a need for a whipped beverage dispenser which does not require refrigeration of a quantity of pre-mixed beverage or daily disassembly of the whipping apparatus for cleaning, and which provides some mechanism for preventing the accumulation of beverage residue within the whipping assembly.

SUMMARY OF THE INVENTION

It is, therefore, an object of the present invention to provide a whipped beverage dispenser in which a concentrate and diluent are stored separately and combined only during whipping and dispensing of the beverage. Another object of the present invention is to provide a whipped beverage dispenser having a self-cleaning capability. Still another object of the present invention is to provide a whipped beverage dispenser having a simplified structure to facilitate cleaning and maintenance. Yet another object of the present invention is to provide a whipped beverage dispenser having an improved foam texture or whip-gain of a whipped beverage.

To accomplish the foregoing and other advantages and objectives, the whipped beverage dispenser of the present invention, in its presently preferred embodiment, includes a unitary whipping head having a whipping chamber, a first conduit leading to the whipping chamber for supplying diluent and a second conduit leading to the whipping chamber for supplying concentrate. Flow control valves are attached to the unitary head in each conduit immediately preceding the whipping chamber. In use, the concentrate and diluent are separately introduced into the whipping chamber to be simultaneously mixed and agitated or whipped. To improve whip-gain a separate air passage is provided connecting with a portion of the diluent conduit immediately preceding the whipping chamber. A tube is lodged within the air passage and partially disposed in the diluent conduit to create a venturi effect as diluent flows past the end of the tube. This tube and the venturi effect also prevents diluent from flowing out of the whipping head through the air passage due to spurious pressures encountered in the whipping chamber during whipping.

A whipping motor having a rotating output shaft terminating in the whipping chamber is provided for mixing and whipping the beverage. A specially configured whipping element is attached to the end of the output shaft in the whipping chamber to effect mixing and whipping. A spinning slinger washer is disposed about the output shaft inside the whipping chamber to prevent beverage from seeping out of the whipping chamber and accumulating about the output shaft.

The novel features which are believed to be characteristic of the invention, together with further objectives and advantages thereof, will be better understood from the following description considered in connection with the accompanying drawings, wherein like numbers identify like elements. It should be expressly understood, however, that the drawings are for purposes of illustration and description only and are not intended as a definition of the limits of the present invention.

BRIEF DESCRIPTION OF THE DRAWINGS

FIG. 1 is a general perspective view of a preferred embodiment of the present inventive whipped beverage dispenser.

FIG. 2 is a perspective view of the unitary whipping head of the present inventive whipped beverage dispenser showing separate concentrate and diluent conduits leading to a whipping chamber.

FIG. 3 is a forward perspective cutaway view of the unitary whipping head exposing the whipping chamber and portions of the diluent and concentrate conduits and the air passage.

DETAILED DESCRIPTION

Figure 4:
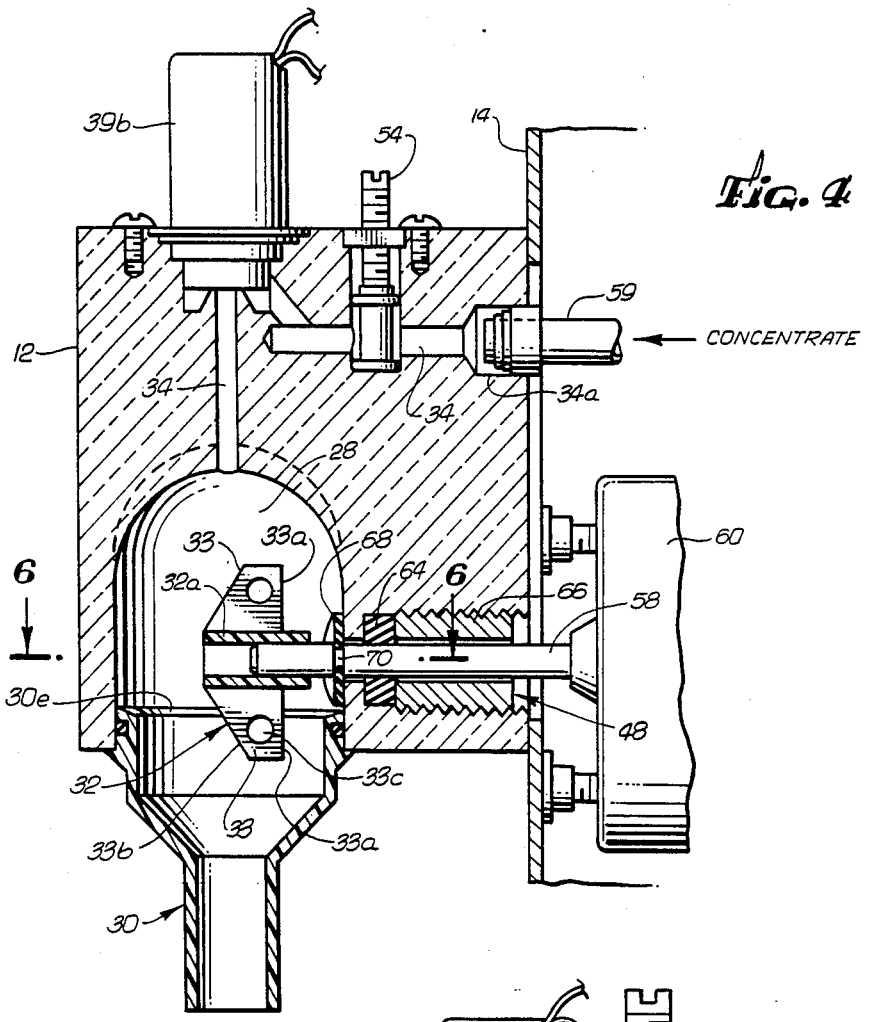
FIG. 4 is a cutaway side view of the unitary whipping head along the line 4—4 in FIG. 3 showing the whipping chamber, the concentrate conduit and related valves, and a whipping apparatus.

Referring now to the figures, and more particularly to FIG. 1 thereof, there is shown a preferred embodiment of the present inventive unitary whipped beverage dispenser, generally designated 10. The beverage dispenser 10 includes a unitary whipping head 12 attached to a support structure 14. The support structure 14 houses a whipping motor and fluid supply lines from a distant diluent source and a concentrate source. A cover tower 16 is placed over the upper portion of unitary whipping head 12 to cover up various flow control valves and metering valves attached to the upper surface of the unitary whipping head 12.

The lower portion of the support structure 14 forms a basin having a drain for collecting spilled beverage. A beverage cup 18, shown in broken lines, rests on a lattice drain support 20. A system switch 22 is located on a forward portion of the support structure 14 below the unitary whipping head 12. The system switch 22 is covered by a flexibly hinged cover 24 attached to a forward portion of the support structure 14. The flexibly hinged cover 24 provides a waterproof shield to protect system switch 22 from contact with spilled beverage. A lever 26 pivotally connected to the bottom portion of unitary whipping head 12 activates a self-cleaning system discussed more fully below.

As shown in FIG. 2, the unitary whipping head 12 has an internal whipping chamber 28 which opens into an output aperture at the bottom of head 12. A funnel element 30 is removably disposed in the whipping chamber output aperture. A paddle element 32 is attached to the output shaft of a whipping motor and disposed within the chamber 28 to effect mixing and agitated foaming or whipping of the beverage.

The upper portion of head 12 includes a concentrate conduit 34 for conveying beverage concentrate into the chamber 28 and a diluent conduit 36 for conveying a diluent to chamber 28. In the presently preferred embodiment, two bores descend from an upper surface **12*a* of head 12 into each of the concentrate and diluent conduits 34, 36. The two forward bores 38 receive solenoid flow control valves 39*a,b*. With respect to the two rearward bores, one bore 40, descending into concentrate conduit 34, receives a concentrate shut-off valve while the other rearward bore 43, descending into diluent conduit 36**, receives a diluent metering valve.

The upper portion of head 12 also includes an air passage 44 extending from the upper head surface **12*a* to a portion of the diluent conduit 36 in proximity to chamber 28. A right-angle cavity 46 is also provided as a passage into the support structure 14 for various electrical wires disposed in proximity to head 12. The lower portion of head 12 includes a bore 48** for receiving an output shaft of the whipping motor.

In the presently preferred embodiment of the invention, the inner walls of head 12 forming chamber 28 are generally smooth and continuous, having only apertures for communicating with the concentrate and diluent conduits 34, 36 and the output shaft bore 48. An O-ring 50, forming a fluid-tight seal between head 12 and funnel 30, is disposed about a groove set in the funnel 30 rather than a groove disposed in the walls of chamber 28. This smooth, generally unbroken surface provides fewer sites for the accumulation of beverage residue and also facilitates cleaning the walls of chamber 28. When it becomes necessary to remove any accumulation of beverage residue about O-ring 50, funnel 30 can be easily removed and washed.

In operation, concentrate and diluent are fed through their respective conduits 34, 36 and separately fed directly into chamber 28. By depressing system switch 22, a whipping motor is activated to rapidly spin paddle element 32 and simultaneously open both solenoid control valves **39*a,b*. Chamber 28 quickly fills with foamed beverage which is dispensed through the funnel 30. The location of air passage 46 in head 12, feeding directly into the terminal portion of diluent conduit 36, substantially improves the whip-gain or foam texture of the dispensed beverage. A small tube 57 is lodged in the terminal portion of air passage 46 and extends into diluent conduit 36. The passage of diluent about tube 57 creates a venturi effect at the end portion of tube 57 disposed in diluent conduit 36. This venturi effect increases the amount of air introduced into cavity 28 thereby improving the whip-gain of the dispenser. This venturi effect further provides for the introduction of air through passage 46, despite spurious pressures created by the rapid spinning of paddle element 32 and agitation of beverage in the cavity 28. It has been found that without the use of the tube 57, diluent flows back through passage 46 and out of the exterior of head 12 rather than air traveling through passage 46 into chamber 28**.

The funnel 30 has a first cylindrical portion **30*a*, a generally conic portion 30*b* and a second cylindrical portion 30*c*. An appropriately configured O-ring groove 30*d* is circumferentially disposed about the first cylindrical portion 30*a*. The upper edge 30*e* of the funnel 30 is beveled to avoid the accumulation of residue at the juncture between the funnel upper edge 30*e* and the inside wall of the whipping chamber 28. A ledge 30*f*, circumferentially disposed about the upper cylindrical portion 30*a*, provides a firm seating of the funnel 30 into the lower portion of chamber 28. It has been found that a funnel of this general configuration provides desireable characteristics in the stream of beverage dispensed from the whipping head 12. Where a funnel lacking a first cylindrical portion 30*a* is used to dispense beverage, the active agitation of the beverage within chamber 28 during whipping causes the dispensing beverage stream to rapidly spread out upon exiting the funnel. Similarly, an undesireable spreading stream is encountered when the length of the second cylindrical portion 30*c* is substantially shorter than the combined lengths of the first cylindrical portion 30*a* and the conic portion 30*b*. The conic portion 30*b* helps to encourage roll-off of beverage from the interior surfaces of funnel 30** at the end of beverage dispensing.

The paddle element 32 is configured for operation in a whipping chamber 28 having an increased air flow. Conventional post-mixed whipping dispenser paddles have been found to overwhip the beverage, producing an undesirably high whip-gain. The paddle element 32 of the present inventive unitary whipping dispenser is a unitary structure having a cylindrical portion **32*a* (FIG. 4) fitting onto a whipping motor output shaft 58 and two opposing blades 33 projecting from the cylindrical portion 32*a*. One edge 33*a* of each blade is generally perpendicular to the cylindrical paddle portion 32*a* while an opposing blade edge 33*b* is tapered towards the perpendicular edge 33*a*. Each blade 33 defines an aperture 33*c***.

FIG. 4 shows a cutaway side view of the head 12 exposing the concentrate conduit 34 and shaft bore 48.

A mating portion 34a of conduit 34 is appropriately configured to form a fluid-tight seal with a concentrate fluid supply line 59. Typically the concentrate source is pressurized. Concentrate shut-off valve 54 is used to seal off the concentrate source and fluid supply line 59 during maintenance or replacement of concentrate solenoid valve 52 without depressurizing the concentrate source. While generally not requiring refrigeration, the concentrate should not be exposed to air. Thus, shut-off valve 54 precludes the introduction of air into the concentrate source or fluid supply line 59 thereby avoiding the need to purge the concentrate fluid supply line 59 after maintenance of concentrate solenoid valve 52.

Figure 6:
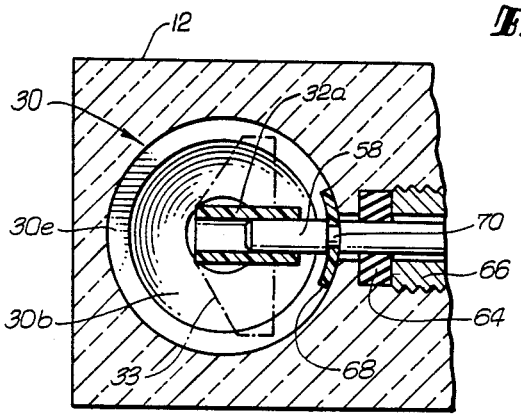
FIG. 6 is a cutaway bottom view of the unitary whipping head along the line 6—6 in FIG. 4.

FIG. 4 also shows a whipping motor 60 and output shaft 58 partially extending through the shaft bore 48 into whipping chamber 28. Two washers are used to provide a fluid-tight seal between chamber 28 and shaft bore 48. A compression washer 64 is disposed at an inner end of bore 48 and provided with appropriate sealing compression by a threaded compression cylinder 66 screwed into a threaded portion of bore 48. A slinger washer 68 is located within chamber 28 in contact with an interior wall of chamber 28. The slinger washer 66 is made of a resilient material and, as shown in FIG. 6, the washer 66 curves to conform to the curvature of the interior wall of chamber 28. When whipping motor 60 is on, washer 66 rapidly rotates along with shaft 58, continually flexing as it continues to conform with the curvature of the chamber 28 interior wall. Any fluid seeping along the interior chamber wall towards the shaft 58 and bore 48 will come in contact with the washer 68. The rapidly spinning motion of washer 68 will impart an outward tangential motion to this fluid, thus expelling the fluid away from shaft 58 and bore 48. This prevents the accumulation of beverage residue along the shaft bore 48 between washers 64 and 48.

Typically on extended cylindrical body portion of a whipping element secures this type of washer to the rotary shaft in contact with a chamber wall. In the preferred embodiment of the present inventive beverage dispenser, however, chamber 28 is not large enough to permit placement onto shaft 58 of a whipping element 32 having an appropriately extended cylindrical portion 32a when the head 12 and whipping motor 60 have already been connected to one another. Therefore, to maintain slinger washer 68 in place, a circumferential groove 70 is formed in shaft 58 just inside chamber 28. The slinger washer 68 is then lodged in groove 70.

Figure 5:
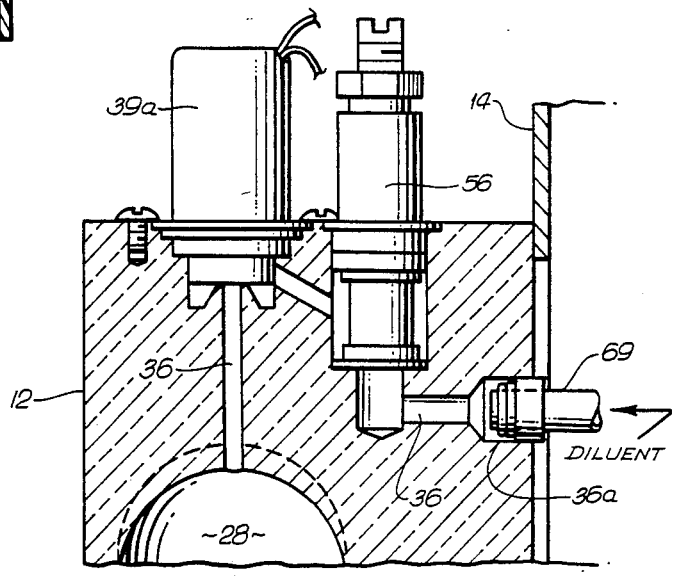
FIG. 5 is a cutaway side view of the unitary whipping head along the line 5—5 in FIG. 3 showing the diluent conduit.

FIG. 5 provides a cutaway side view of the head 12 exposing the diluent conduit 36. As with the concentrate conduit 34, a mating portion 36a of diluent conduit 34 is also appropriately configured to form a fluid-tight seal with a diluent fluid supply line 69. In the presently preferred embodiment, a concentrate metering valve (not shown) is disposed within the support structure 14. The diluent metering valve 56, however, is located on unitary whipping head 12 to facilitate ease of adjusting beverage composition. The concentrate metering valve is usually pre-set to a desired flow rate and diluent metering valve 56 subsequently adjusted to obtain an appropriate beverage composition and texture. The appropriate diluent-to-concentrate ratio is determined by activating the system and observing the consistency and texture of the resulting beverage. By locating diluent metering valve 56 on whipping head 12, adjustments can be more easily made and the desired consistency of the resulting beverage more rapidly obtained.

Figure 7:
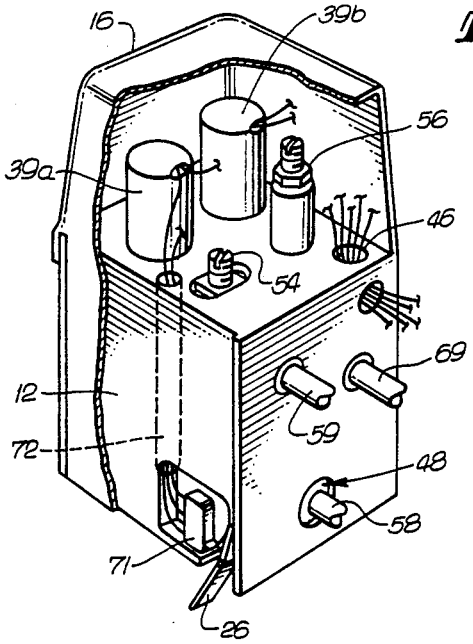
FIG. 7 is a perspective rear view of the unitary whipping dispenser of the present invention.

A rearward perspective view of the unitary whipping head 12 and associated dispenser elements is shown in FIG. 7. As shown, the lever 26 is disposed within a small cavity in head 12 along with a switch 71. A shaft 72 provides a passage for lead wires extending from switch 71 to diluent solenoid valve 39a and the whipping motor 60. The lever 26 is pivotally coupled to the head 12 so that pressing lever 26 towards support structure 14 causes the lever 26 to engage and close switch 71. When closed, switch 71 activates the whipping motor 60 and causes diluent solenoid valve 39a to open. This provides a flow of diluent into chamber 28 which is agitated by the high-speed rotation of paddle element 32. This agitated flow of diluent serves to flush any beverage residue remaining in chamber 28. It has been found that the whipping motion of paddle element 32 and the subsequent agitation of the diluent disposed in chamber 28 is sufficiently vigorous to also flush any concentrate residue residing in the portion of concentrate conduit 34 extending from the chamber 28 up to the concentrate solenoid valve 39b. Thus, switch 71 provides a self-cleaning feature which serves to cleanse all the interior portions of head 12 which could be subject to an accumulation of beverage residue. In this manner, disassembly of the unitary whipping head 12 for cleaning usually is unnecessary.

The present inventive unitary beverage dispenser can be used to dispense a wide variety of beverages. It is particularly well suited for dispensing and whipping beverages made from a concentrate subject to bacterial growth after exposure to air or diluent and therefore requiring particular care in sanitation and cleaning. It will, of course, be understood that other modifications of the present inventive whipped beverage dispenser will be apparent to those skilled in the art. For example, diluent metering valve 56 could be located along with a concentrate metering valve within support structure 14. For beverages where bacterial growth is not a problem, the self-cleaning feature and related elements are unnecessary. Consequently, the scope of the present invention should not be limited by the particular embodiment discussed above, but should be defined only by the claims set forth below and equivalents thereof.

What is claimed is:

1. A beverage dispenser for a frothed beverage prepared by combining a non-premixed beverage concentrate and a non-carbonated diluent, said dispenser comprising:

a unitary whipping head defining therewithin a whipping chamber, communicating with an output aperture of said whipping head, for mixing and agitation within said whipping chamber of said non-premixed concentrate and said diluent to produce a frothed beverage, and for dispensing said frothed beverage through said output aperture;

a first conduit within said unitary head, communicating with the exterior of said whipping head and said whipping chamber, for supplying said non-premixed concentrate;

a second conduit within said unitary head, communicating with the exterior of said whipping head and said whipping chamber, for supplying said non-carbonated diluent to said whipping chamber;

a third conduit, communicating with the exterior of said whipping head and having a venturi effect creating opening into said second conduit, for introducing air into said whipping chamber by entrainment of air by the venturi effect into the supplied diluent;

a bore, communicating with the exterior of said whipping head and said whipping chamber, for receiving a rotating output shaft; and a whipping element disposed within said whipping chamber and attached to said rotating output shaft;

wherein non-premixed concentrate and diluent with entrained air are introduced into said whipping chamber respectively through said first and second conduits and collectively agitated by said whipping element to froth said beverage immediately prior to said dispensing, and a dispensing funnel having a first cylindrical portion, partially disposed in said output aperture to define a generally enclosed bottom for said whipping chamber, said funnel having a conic portion tapering from said first cylindrical portion to a smaller diameter, and having a second cylindrical portion having said smaller diameter and depending from the tapered portion for a distance sufficient to limit spreading of the dispensed frothed beverage.

2. The beverage dispenser of claim 1 wherein interior walls of said whipping head defining said whipping chamber are generally smooth and continuous.

3. The beverage dispenser of claim 1 further comprising:

a venturi tube having a first portion lodged within said third conduit and an opposing second portion extending into said second conduit, wherein the flow of diluent through said second conduit causes a venturi effect at the end of said venturi tube disposed within said second conduit.

4. The beverage dispenser of claim 3 further comprising a shut-off valve, partially disposed within said whipping head and said first conduit, for sealing the flow of said concentrate through said first conduit.

5. The beverage dispenser of claim 4 further comprising electric switching means for activating said motor and for initiating the flow of diluent through said second conduit, wherein beverage residue is substantially removed from said whipping chamber upon such times as said shut-off valve does seal the flow of said concentrate through said first conduit.

6. The beverage dispenser of claim 1 further comprising a rotating slinger washer disposed about said output shaft within said whipping chamber and adjacent an interior wall thereof, and wherein said slinger washer, upon rotation with said shaft, restricts the flow of fluid from said whipping chamber to said whipping head bore and slings said fluid back toward said whipping element.

7. The beverage dispenser of claim 6 wherein said output shaft defines a circumferential groove disposed about a portion of said output shaft located within said whipping chamber and wherein said slinger washer is disposed about said groove.

8. The beverage dispenser of claim 6 wherein said slinger washer is composed of a resilient material.

9. The beverage dispenser of claim 1 wherein said whipping element has two blades each defining an aperture.

10. A beverage dispenser for a whipped beverage prepared by combining a non-premixed concentrate and a diluent, said dispenser comprising:

a unitary whipping head defining a whipping chamber, communicating with an output aperture of said whipping head, for mixing and agitation within said whipping chamber of said beverage, a first conduit communicating with the exterior of said whipping head and said whipping chamber for supplying concentrate, a second conduit communicating with the exterior of said whipping head and said whipping chamber for supplying diluent, a third conduit communicating between the exterior of said whipping head and said second conduit for introducing air into said whipping chamber, a bore communicating with the exterior of said whipping head and said whipping chamber for receiving an output shaft of a motor, a first flow valve partially disposed within said first conduit, a second flow valve partially disposed within said second conduit, a whipping element disposed within said whipping chamber and attached to said motor output shaft, wherein concentrate and diluent and air are separately introduced into said whipping chamber respectively through said first, second and third conduits and agitated immediately prior to dispensing, a dispensing funnel removably attached to said output aperture, said funnel having a first cylindrical portion, partially disposed in said whipping chamber, with a first diameter, having a conic portion attached to said first cylindrical portion and tapering from said first diameter to a second diameter, and having a second cylindrical portion having said second diameter and extending from the tapered portion, and a venturi tube having a first portion lodged within said third conduit and an opposing second portion extending into said second conduit, wherein the flow of diluent through said second conduit causes a venturi effect at the end of said venturi tube disposed within said second conduit.

11. The beverage dispenser of claim 10 wherein the interior walls of said whipping head defining said whipping chamber are generally smooth and continuous.

12. The beverage dispenser of claim 10 further comprising a shut-off valve, partially disposed within said whipping head and communicating with said first conduit between the exterior of said whipping head and said first flow valve for sealing the flow of said concentrate through said first conduit.

13. The beverage dispenser of claim 12 further comprising electric switching means, attached to said whipping head, for activating said motor and opening said second valve, wherein beverage residue is substantially removed from said whipping chamber upon such times as said shut-off valve does not seal the flow of said concentrate through said first conduit.

14. The beverage dispenser of claim 10 further comprising a resilient, rotating slinger washer disposed within said output and shaft in contact with an interior wall of said whipping chamber, wherein said slinger washer restricts the flow of fluid from said whipping chamber through said whipping head bore.

15. The beverage dispenser of claim 14 wherein said output shaft defines a circumferential groove disposed about a portion of said output shaft located within said whipping chamber and wherein said slinger washer is disposed about said groove.

16. The beverage dispenser of claim 10 wherein said whipping element has two blades with each blade defining an aperture.

17. A whipped beverage dispenser, comprising:

a unitary head formed of a block, a dome-shaped whipping cavity formed in said block and opening to the bottom thereof, said cavity having a domed top, sides and a bottom opening, a funnel-shaped nozzle removably insertable into said opening, a diluent fluid passageway formed in said block and communicating to the domed top of said whipping cavity, a venturi air inlet communicating to said diluent passageway, the flow of diluent to said whipping cavity via said diluent passageway entraining air from said inlet by the venturi effect into the supplied diluent, a concentrate fluid passageway formed in said block and communicating to the domed top of said whipping cavity, for supplying a non-premixed beverage concentrate to said whipping cavity, and a rotatable whipping paddle situated within said whipping cavity and rotatable therewithin about a horizontal axis so as to mix and froth the supplied non-premixed beverage concentrate and air entrained diluent, the frothed product being delivered via the bottom opening and said funnel-shaped nozzle.

18. A dispenser according to claim 17 wherein said nozzle includes an upper cylindrical portion insertable into said opening, a downwardly depending cylindrical portion of diameter substantially smaller than said upper cylindrical portion, and a conical portion intermediate said upper and depending cylindrical portions, said downwardly depending cylindrical portion being sufficiently long to prevent spreading of the delivered frothed product.

19. A process for dispensing a post-whipped beverage, comprising:

introducing a non-premixed beverage concentrate in fliud form via a first channel into a generally upper domed whipping chamber having a bottom, said bottom being funnel-shaped and having a downwardly directed funnel outlet cylinder of diameter smaller than that of said whipping chamber, concurrently introducing beverage diluent and air into said whipping chamber via a second fluid channel having a venturi air inlet, whipping said concentrate, diluent and venturi-induced air with a rotary paddle in said chamber as said concentrate and diluent are introduced thereto, to produce a frothed and whipped beverage, and permitted said frothed and whipped beverage to flow without interruption out from said whipping chamber bottom via said funnel outlet cylinder, thereby to dispense said whipped beverage, said funnel outlet cylinder limiting the spreading of said dispensed whipped beverage.

20. The process of claim 19 together with the additional steps for cleaning said chamber, comprising:

blocking said first channel to prevent the flow of concentrate to said chamber, introducing water as said diluent to said chamber via said second channel having a venturi air inlet, rotating said paddle in said chamber as said water and venturi-induced air are introduced, and permitting said paddle agitated water and air to unimpededly flow out from said chamber bottom, thereby to effectuate cleaning of said chamber.

21. A beverage dispenser for a frothed beverage prepared by combining a non-premixed beverage concentrate and a non-carbonated diluent, said dispenser comprising:

a unitary whipping head defining therewithin a whipping chamber, communicating with an output aperture of said whipping head, for mixing and agitation within said whipping chamber of said non-premixed concentrate and said diluent to produce a frothed beverage, and for dispensing said frothed beverage through said output aperture;

a first conduit within said unitary head, communicating with an exterior of said whipping head and said whipping chamber, for supplying said non-premixed concentrate;

a second conduit within said unitary head, communicating with the exterior of said whipping head and said whipping chamber, for supplying said non-carbonated diluent to said whipping chamber;

a third conduit, communicating with the exterior of said whipping head and said whipping chamber for introducing air into said whipping chamber;

a bore, communicating with the exterior of said whipping head and said whipping chamber, for receiving a rotating output shaft; and a whipping element disposed within said whipping chamber and attached to said rotating output shaft;

said first and second conduits having respective separate openings into said whipping chamber, the portions of said first and second conduits adjacent said openings being oriented to direct the respective separate flows of supplied concentrate and supplied non-carbonated diluent toward said whipping element;

wherein said non-premixed concentrate, said diluent and air, introduced into said whipping chamber respectively through said first, second and third conduits, are mixed and collectively agitated by said whipping element to froth said beverage immediately prior to said dispensing, and a dispensing funnel having a first cylindrical portion, partially disposed in said output aperture to define a generally enclosed bottom for said whipping chamber, said funnel having a conic portion tapering from said first cylindrical portion to a smaller diameter, and having a second cylindrical portion having said smaller diameter and depending from the tapered portion for a distance sufficient to limit spreading of the dispensed frothed beverage.

22. A whipped beverage dispenser, comprising:

a unitary head formed of a block;

a dome-shaped whipping cavity formed in said block and opening to the bottom thereof, said cavity having a domed top, sides and a bottom opening;

a funnel-shaped nozzle in said opening;

a diluent fluid passageway formed in said block and communicating to the domed top of said whipping cavity, and means for supplying a non-carbonated diluent under pressure to said whipping cavity via said diluent fluid passageway;

an air inlet communicating to said whipping cavity;

a concentrate fluid passageway, separate from said diluent fluid passageway, formed in said block and communicating to the domed top of said whipping cavity, and means for supplying a non-premixed beverage concentrate under pressure to said whipping cavity via said concentrate fluid passageway; and a rotatable whipping paddle situated within said whipping cavity and rotatable therewithin about a horizontal axis so as to both mix and froth the supplied non-premixed beverage concentrate with said supplied non-carbonated diluent and air, the frothed product being delivered via the bottom opening and said funnel-shaped nozzle;

the respective terminal portions of each of said separate diluent and concentrate fluid passageways being oriented within said block so as to direct the respective separate flows of supplied diluent and concentrate toward said whipping paddle.

23. A dispenser according to claim 22 wherein said nozzle includes an upper cylindrical portion insertable into said opening, a downwardly depending cylindrical portion of diameter substantially smaller than said upper cylindrical portion, and a conical portion intermediate said upper and depending cylindrical portions, said downwardly depending cylindrical portion being sufficiently long to prevent spreading of the delivered frothed product.

24. A beverage dispenser for a whipped beverage prepared by combining a non-premixed concentrate and non-carbonated diluent, said dispenser comprising:

a unitary whipping head defining a whipping chamber, communicating with an output aperture of said whipping head, for mixing and agitation within said whipping chamber of said beverage;

a first conduit communicating with the exterior of said whipping head and said whipping chamber for supplying said non-premixed concentrate;

a second conduit, separate from said first conduit, communicating with the exterior of said whipping head and said whipping chamber for supplying said non-carbonated diluent;

a third conduit communicating with the exterior of said whipping head for introducing air into said whipping chamber;

a bore communicating with the exterior of said whipping head and said whipping chamber for receiving an output shaft of a motor;

a first flow valve in fluid circuit with said second conduit;

a whipping element disposed within said whipping chamber and attached to said motor output shaft, wherein concentrate, diluent and air are separately introduced into said whipping chamber respectively through said first, second and third conduits and are mixed and agitated within said whipping chamber immediately prior to dispensing, the end portions of said first and second conduits being oriented so as to respectively direct the separate flows of introduced concentrate and diluent toward said whipping element; and a funnel shaped member situated in said output aperture so as to effectively enclose said whipping chamber for effective frothing of said beverage therewithin.

25. The beverage dispenser of claim 24 wherein:

said first flow valve is a shut-off valve, partially disposed within said whipping head and said first conduit, for sealing the flow of said concentrate through said first conduit, together with:

electric switching means for activating said motor and for initiating the flow of diluent through said second conduit while said shut-off valve seals the flow of said concentrate through said first conduit, so that beverage residue is substantially removed from said whipping chamber by the diluent which is agitated in said chamber by said whipping element.

* * * * *